US006065942A

United States Patent [19]

Glidden et al.

[11] Patent Number: 6,065,942

[45] Date of Patent: May 23, 2000

[54] UTILITY PACKAGE INCLUDING AN AIR COMPRESSOR AND A TOOL COMPARTMENT

[75] Inventors: Travis Glidden, Garner; Francis L. Zrostlik, Clear Lake; Thomas G. Formanek, Britt, all of Iowa

[73] Assignee: Stellar Industries, Inc., Garner, Iowa

[21] Appl. No.: 09/076,543

[22] Filed: May 12, 1998

[51] Int. Cl.[7] ..... F04B 41/00

[52] U.S. Cl. ..... 417/236; 417/234; 224/404; 224/42.42

[58] Field of Search ..... 417/236, 234, 417/63; D15/9; D26/38; 224/404, 42.42; 200/61.62; 62/239; 73/37

[56] References Cited

U.S. PATENT DOCUMENTS

| | | | |
|---|---|---|---|
| 4,375,162 | 3/1983 | Eppley | 200/61.62 |
| 4,389,166 | 6/1983 | Harvey et al. | 417/234 |
| 4,543,798 | 10/1985 | Page | 62/239 |
| 4,715,787 | 12/1987 | Hung | 417/63 |
| 4,830,579 | 5/1989 | Cheng | 417/234 |
| 4,850,519 | 7/1989 | Farmer | 224/404 |

OTHER PUBLICATIONS

Weather Guard, Cross Boxes, internet web site: www.acetruckbox.com/wguard.crosbox.html, pp. 1–4, Oct. 6, 1999.

Continental Accessories, Truck and Tool Boxes, internet web site: www.autostyles.com/continen.htm, pp. 1–2, Oct. 5, 1999.

Electronics Outpost, Portable Air Compressor, internet web site: www.electronicsoutpost.com/aircomp.htm, p. 1, Oct. 5, 1999.

Thunderbolt Power Equipment, High Performance Gas Drive, internet web site: www.gohonda.com/aircomg/k18html, pp. 1–2, Oct. 6, 1999.

*Primary Examiner*—Timothy S. Thorpe
*Assistant Examiner*—Steven Brown
*Attorney, Agent, or Firm*—Wood, Phillips, VanSanten, Clark & Mortimer

[57] ABSTRACT

A utility package for installation in the bed of a pickup truck includes a frame (10) having a relatively narrow, lower vertical section (12) of a width W1 narrower than the interior spacing between the sides of the pickup truck bed while substantially spanning the entire interior distance between such sides and a relatively wide, upper horizontal section (14) of a width greater than the interior spacing between the sides and no greater than about the distance between the exteriors of the sides and adapted to be supported on the tops of the sides. An elongated pressure vessel (26) is located within the vertical section (12) and a pair of upright housing sections (64,68) are mounted on the horizontal section (14) oppositely of the vertical section (12). The housing section (64,68) have access openings (78) at respective ends (16,18) of the horizontal section (14). An air compressor unit (48) is mounted on the frame between the housing section (64,68) and a tool box (70) is located in the vertical section (12) adjacent one end (16) and above the pressure vessel (26) to be accessible through the housing section (68). At least one hose reel (36,38) is mounted in the vertical section adjacent the other end (18) of the horizontal section (14) and is accessible through the housing section (64) at the end (18) of the horizontal section (14).

16 Claims, 5 Drawing Sheets

68
110
64
54
50
16
78
48
38
14
12
46
36
28
22
30
20
120
24
122
18
32
32
10
112
26

UTILITY PACKAGE INCLUDING AN AIR COMPRESSOR AND A TOOL COMPARTMENT

FIELD OF THE INVENTION

This invention relates to a utility package, and more specifically, to a utility package for installation on the bed of a pickup truck. The utility package includes an air compressor and related items as well as a tool compartment.

BACKGROUND OF THE INVENTION

The construction and tire servicing industries have long required mobility as an integral part of their businesses. Tradesmen are required to transport their tools to and from their place of work as well as between construction sites. Construction materials also must be moved from a place of purchase to a construction site. The tire servicing industry is frequently required to travel to service tires, particularly those used on large or off-the-road vehicles, as farm tractors. In these operations, equipment required to service tires, tires and wheels must be moved to the vehicle site.

As a consequence of these and other needs, extensive use of pickup trucks is made by both industries. Pickup trucks used by the construction industry may be owned by construction firms or, in many cases, are owned by the workers employed by the firm. For the purpose of transporting tools whether for construction or for tire servicing, it is conventional to employ tool boxes which are mounted in the bed of the pickup truck just behind the cab. Such tool boxes typically include a lower section which fits between the side walls of the truck bed and an upper section from which the lower section depends. The upper section is somewhat wider than the lower section and is supported by the upper surfaces of the sides of the bed of the pickup truck.

Additionally, it is frequently necessary to provide some sort of means for operating power tools at a construction site, particularly when electric power may not be available or when pneumatic power is required. Consequently, many construction workers own generators or air compressors which they transport to and from and between construction sites in the bed of their pickup truck. Where possible, to avoid the effort of off-loading a generator or an air compressor, they are simply left on the truck bed and the truck moved in sufficient proximity to the location where construction is occurring that electrical tools such as drills, saws, etc. or pneumatic tools such as nailers can respectively be connected to a generator or an air compressor. In tire servicing an air compressor is also required for the purpose of inflating tires as a remote site.

In some instances, electrical generators, air compressor series and/or tool boxes are made part of a permanent installation on a vehicle. While this works well for its intended purpose, if the useful life of the truck does not coincide with the useful life of the generator, air compressor or tool box, a substantial inconvenience arises when one or the other or more of these components require replacement.

Furthermore, when individual electrical generators or air compressors are carried in a bed of a truck, they must frequently be tied down while the truck is in motion to prevent shifting that could damage the bed of the truck or the air compressor or electrical generator or both. Not untypically, whatever restraints are used during transportation of such components are loosened or removed when the electrical generator or air compressor is in operation, requiring additional effort on the part of the user.

The present invention is directed to overcoming one or more of the above problems.

SUMMARY OF THE INVENTION

It is the principal object of the invention to provide a new and improved utility package for installation in the bed of a pickup truck. More particularly, it is an object of the invention to provide a utility package containing an air compressor and a tool compartment.

An exemplary embodiment of the invention achieves the foregoing objects in a structure including a frame having a relatively narrow, lower vertical section of a width narrower than the interior spacing between the sides of the bed of the pickup while substantially spanning the entire distance between those sides. The frame has a relatively wide, upper section of a width greater than the interior spacing between the sides and no greater than about the distance between the exterior of the sides and adapted to be supported on the tops of the sides of the pickup truck bed. At least one elongated pressure vessel is located within the vertical section and a housing is mounted on the horizontal section oppositely of the vertical section and extends to opposite ends of the horizontal section. The housing has access openings at the respective ends of the horizontal section. A closure is provided for each of the access openings and is mounted on the housing for movement between positions opening and closing the associated access opening. An air compressor is mounted on the frame between the access openings and a motor or an engine is located on the frame between the access openings and connected to the air compressor to drive the same. A tool box is located in the vertical section adjacent one end of the horizontal section and above the pressure vessel to be accessible through the housing at the one end and at least one hose reel is mounted in the vertical section adjacent the other end of the horizontal section and is accessible through the housing at the other end of the horizontal section.

In a preferred embodiment, the frame is generally T-shaped. In a highly preferred embodiment, the pressure vessel is elongated in the horizontal direction.

In a highly preferred embodiment, the housing is divided into two housing sections, each mounted on the horizontal section oppositely of the vertical section with each housing located at a respective end of the horizontal section.

In a preferred embodiment, the tool box is an upwardly opening tool box.

In a preferred embodiment, the tool box is a rectangular container having an open upper end surrounded by depending sidewalls and having a bottom wall just above the pressure vessel. The side walls and the bottom walls are disposed within the vertical section and the open upper end is disposed in the horizontal section and covered by one of the housings.

In a highly preferred embodiment, a fluid reservoir is located in the vertical section and interposed between the pressure vessel and the air compressor.

In one embodiment the pressure vessel has a length less than the width of the vertical section. A mounting bracket is located within the vertical section adjacent an end of the pressure vessel and the hose reels are mounted on the mounting bracket.

In one embodiment, one end of the horizontal section includes a generally horizontal, tool-receiving surface with tool retaining means mounted on the upper side of the tool receiving surface.

Preferably, the tool retaining means comprise a plurality of upwardly directed projections and even more preferably, the projections are rods.

In a highly preferred embodiment, there are a plurality of the pressure vessels in generally side-by-side, parallel relation defining a generally horizontal plane.

The invention further contemplates a cover panel extending between the housing sections and covering the air compressor and the motor or engine.

In one embodiment of the invention, at least one exterior light is mounted on the exterior of at least one of the housings.

In a preferred embodiment of the invention, at least one interior light is mounted on the interior of one of the housings.

In a highly preferred embodiment of the invention, a control panel is mounted in the housing section containing the hose reels.

Other objects and advantages will become apparent from the following specification taken in connection with the accompanying drawings.

DESCRIPTION OF THE PREFERRED EMBODIMENTS

Figure 2:
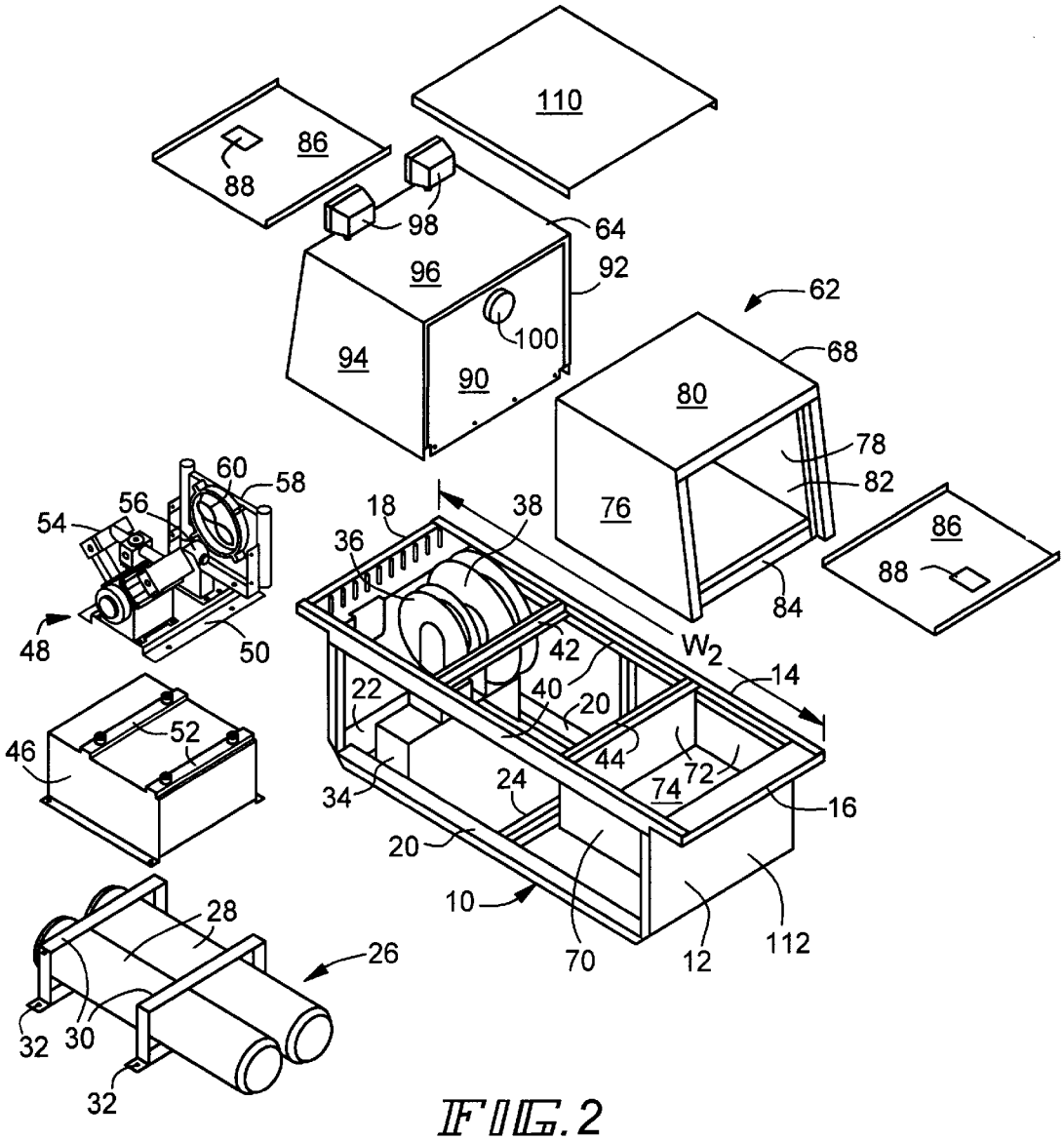
FIG. 2 is an exploded view of the utility package.

Referring to the drawings, an exemplary embodiment of a utility package for installation in the bed of a pickup truck includes a frame, generally designated 10. The frame, as best seen in FIG. 2, is generally T-shaped and includes a lower, vertical section 12 which has a width or end-to-end dimension that is just slightly less than the interior dimension between the sides of a conventional pickup truck. This dimension is marked W1 in FIG. 3. The top of the frame 10 includes a generally horizontal section 14. It has a width or an end-to-end dimension W2 (FIG. 2) that is greater than the distance between the interior sides of the pickup truck bed and approximately equal to the distance between the exterior of the sides of the pickup truck bed. The top to bottom dimension of the vertical section 12 is such that when the package is installed in the bed of a pickup truck, the end sections 16,18 of the horizontal section 14 will rest on the upper surfaces of the sides of the bed of the pickup truck. Conventional means may be utilized to secure the frame 10 to the bed of the pickup truck. Typically hooks or bolts that extend into pre-existing openings in the upper sides of the bed of the pickup truck are used.

The vertical section 12 includes two lower, spaced frame members 20 (FIG. 2) which are parallel to one another and which may be formed of channel or angle iron or the like. At each end of the frame members 20, cross members 22 are located and interconnect the frame members 20. An intermediate cross member 24 may also be employed. Again, the cross members 22 and 24 may be formed of angle iron or channel.

An air storage reservoir, generally designated 26, is located in the vertical section 12. The air reservoir 26 is made up of two, side-by-side, generally parallel, elongated pressure vessels 28 held together by a pair of spaced combination straps and mounting brackets 30. The combination straps and mounting brackets 30 surround the pressure vessels 28 and include feet 32 on both ends which are secured to the frame members 20, preferably by threaded fasteners.

It is noted that through the use of plural pressure vessels in side-by-side relation and in a common horizontal plane, the vertical profile of the air reservoir 26 may be minimized for compactness.

Figure 1:
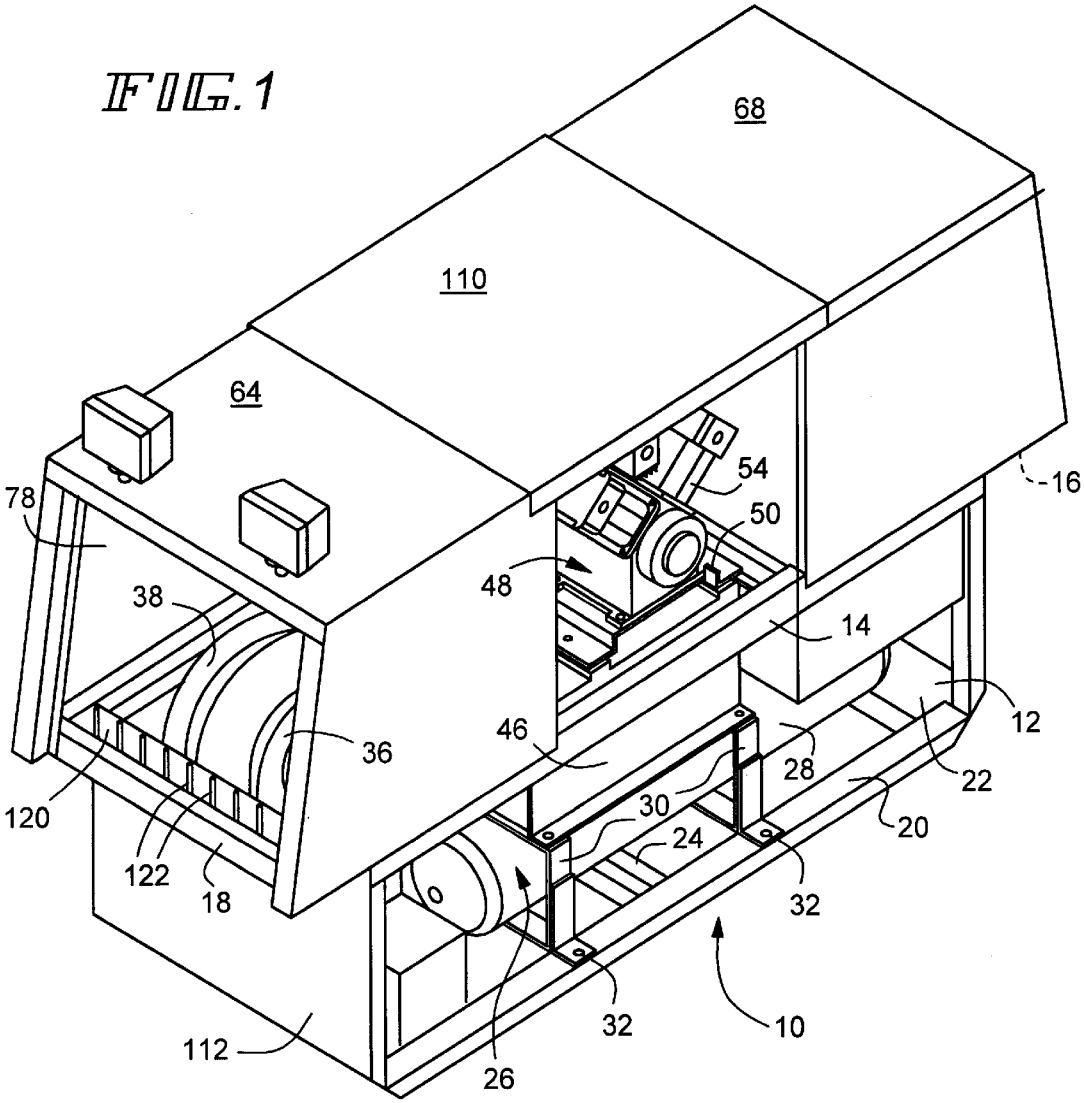
FIG. 1 is a perspective view of a utility package made according to the invention.
Figure 3:
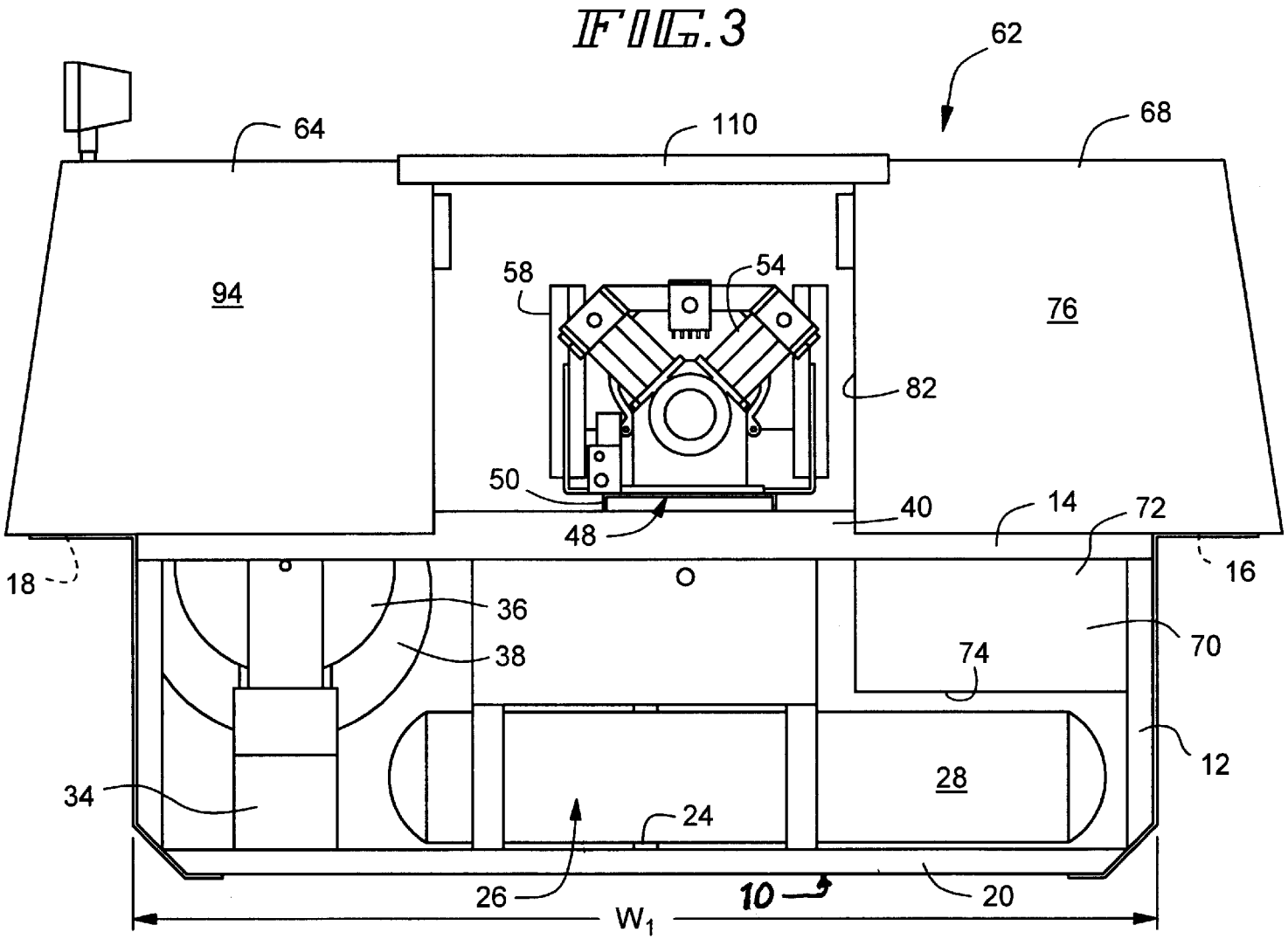
FIG. 3 is a rear elevation of the utility package.

It should also be noted, particularly in FIGS. 1 and 3, that the air reservoir 26, though horizontally elongated, does not have a length equal to the dimension W1. This leaves room for a mounting bracket 34 which extends between the frame members 20 and is secured thereto by any suitable means, typically by a weldment. The mounting bracket 34, in turn, mounts to conventional hose reels 36,38 adjacent the end 18 of the horizontal section 14. To provide flexibility in supplying air to an air operated tool or the like, the two hose reels 36 and 38 are used and one hose reel will be, for example, provided with a half inch hose while the other may be provided with a ⅜" hose of shorter length. To suit this end, the hose reel 36 may be made smaller than the hose reel 38 to receive the smaller diameter, shorter pneumatic hose.

Turning now to the upper, horizontal section, the same is defined by spaced frame members 40 that are located above the frame members 20 and are generally parallel thereto. The end sections 16,18 interconnect respective ends of the frame members 40 and desirably, two cross members 42,44 divide the horizontal section 14 approximately into thirds. In a preferred embodiment, with the reservoir 26 installed within the vertical section 12, the combination straps and mounting brackets 30 will be disposed to be within that part of the horizontal section 14 delineated by the cross members 42 and 44. A hydraulic reservoir 46 is located in the vertical section 12 between the cross members 40 and 44 and secured, as by threaded fasteners, to the combination straps and support brackets 30. It should be noted that in the embodiment of the invention shown in FIG. 5, the hydraulic reservoir 46 may be dispensed with.

An air compressor unit, generally designated 48, has its base 50 partially nested within the vertical section 12 by being secured to mounting brackets 52 located on the upper side of the hydraulic reservoir 46. The air compressor unit 48 preferably is a model SHD-60A available from Stellar Industries, Inc. of Gamer, Iowa. Typically, it will include a four cylinder air compressor 54 driven by a hydraulic motor 56. The unit will also include a heat exchanger 58 which serves as an oil cooler for hydraulic fluid and a fan 60 which may be driven by an electrical motor (not shown) for forcing air through the oil cooler 58. Make up fluid for the hydraulic circuit including the motor 56 and oil cooler 58 is stored in the reservoir 46.

Mounted on the upper side of the horizontal section 14 and oppositely of the vertical section 12 is a housing, generally designated 62. The housing 62 in turn is made up of two housing sections 64 and 68, the former being at the end section 18 and the latter at the end section 16 of the horizontal section 14. Thus, the air compressor unit 48 is nested between the housing sections 64 and 68 as illustrated in FIGS. 1 and 3, for example.

The housing sections 64 and 68 serve to provide secure, tool storage areas. To this end, a rectangular, upwardly opening tool box 70 is located within the vertical section 12 adjacent the end 16. The tool box 70 includes vertical sides 72 and a bottom 74. The same is supported by the cross members 42,44 and has its bottom 74 located just above the upper surface of the air reservoir 26. The housing section 68 is located at the end 16 and includes vertical side walls 76 and 78 which are ever so slightly trapezoidal, a top wall 80 and a rear wall 82 facing the air compressor unit 48. As a consequence, a generally vertical access opening 82 is defined by the top 80, the side walls 76 and 78, and a cross member 84 interconnecting the sides 76 and 78 at their lower extremities. Thus, the tool box 70 is accessible through the housing section 68.

A slidable, stowable door 86, of conventional construction is adapted to be received on rails (not shown) on the interior of the housing section 68 just below the top 80. When located on the rails, the compartment door is in a stowed, open position. The same may be moved forwardly and pivoted downwardly in a conventional fashion to close the access opening 82. A lock of conventional construction, shown somewhat schematically at 88, may be provided to lock the door 86 in its closed position.

If desired, one or more shelves (not shown) may be located within the housing section 68 along with, for example, a compartment light for illuminating the interior of the housing section 68.

The housing section 64 is constructed generally similarly to the housing section 68 to include a rear panel 90, opposed side panels 92 and 94, a top panel 96, and a cross member (not shown). A door 86 with a lock 88 identical to the construction employed with the housing section 68 is also utilized.

As seen in the various figures, exterior floodlights 98 may be mounted on the upper wall 96 of the housing section 64. For that matter, similar floodlights could be mounted on the upper wall 80 of the housing compartment 68.

Figure 4:
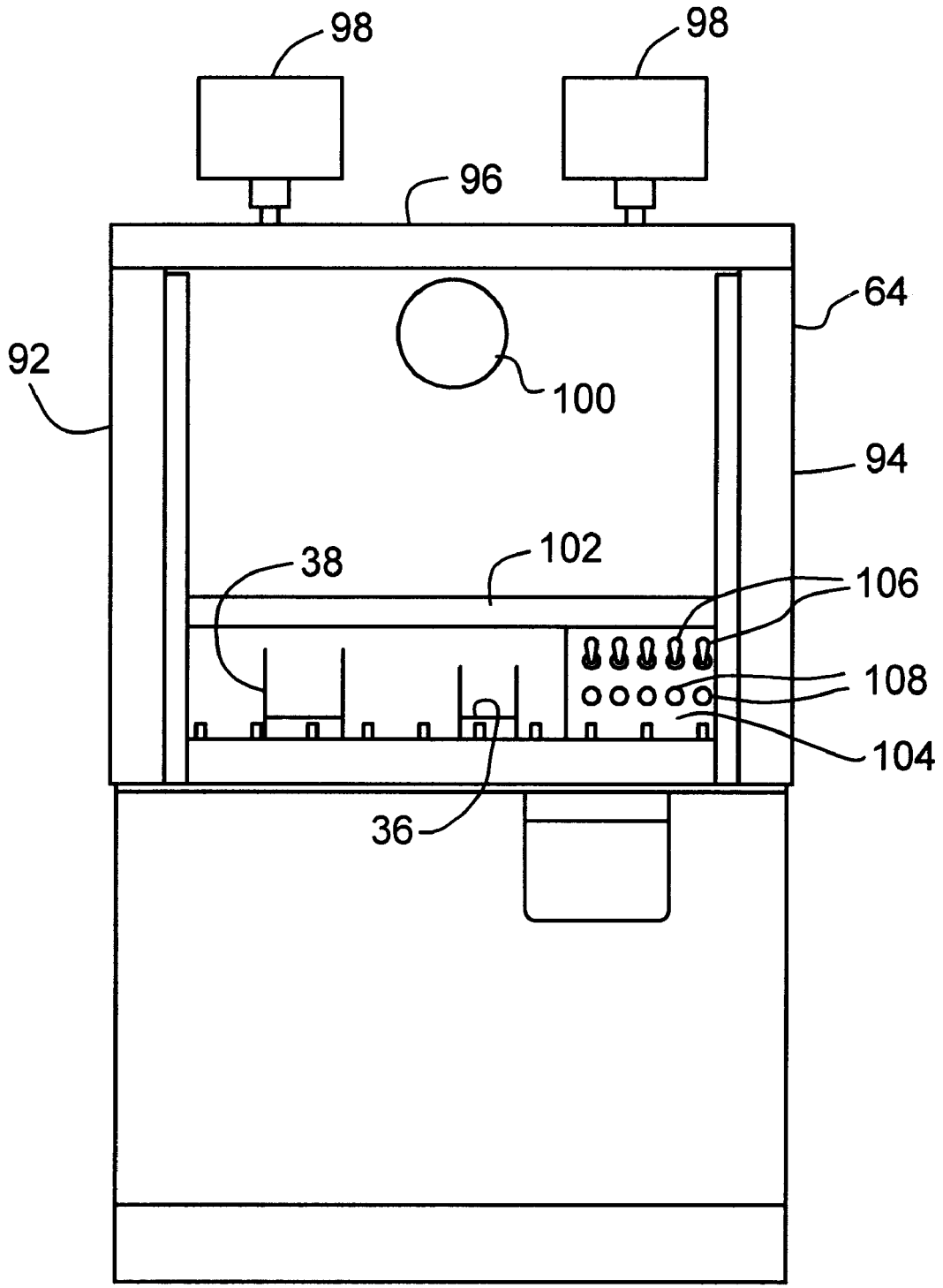
FIG. 4 is a side elevation of the utility package.

As best seen in FIGS. 2 and 4, the rear wall 90 of the housing compartment 64 is provided with a lighting fixture 100 which may be utilized to illuminate the interior of the housing section 64.

Referring specifically to FIG. 4, the interior of the housing section 64 is illustrated and desirably includes a shelf 102 located just above the larger one of the hose reels 38. To one side of the hose reels 36 and 38, a control panel 104 may be provided. Electrical switches 106 may be used to control, for example, the operation of a power takeoff on the engine of the pickup truck to which the package is mounted for providing hydraulic fluid under pressure to the hydraulic motor 56 (FIG. 2) to drive the air compressor unit 48. Switches 106 may also be employed to illuminate the interior light 100 or the exterior floodlights 98.

Indicator lights 108 for the various control functions may also be located on the control panel 104.

Figure 5:
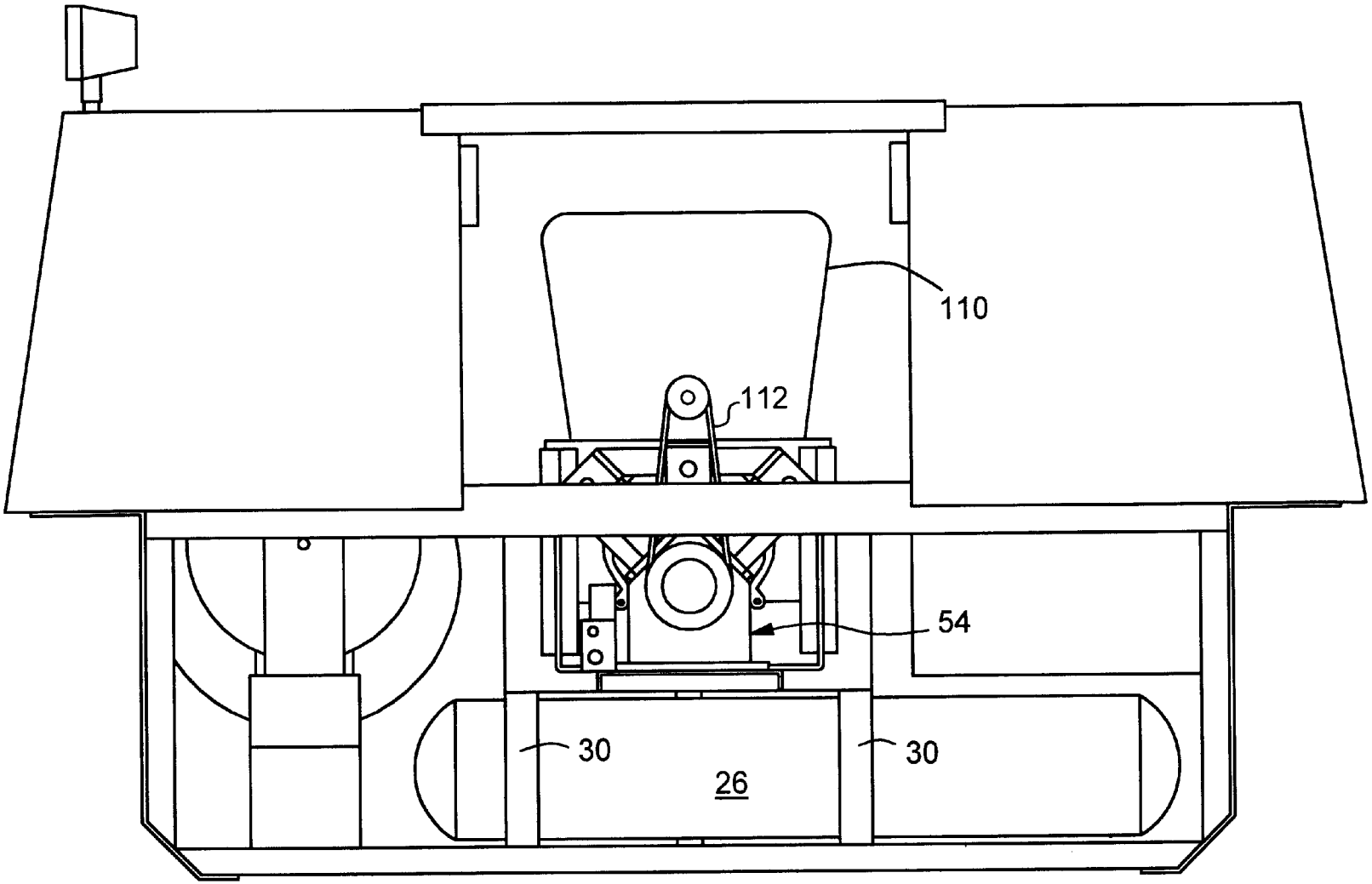
FIG. 5 is a view similar to FIG. 3 but of a modified embodiment of the invention.

In some instances, an engine driven air compressor may be employed as seen in FIG. 5. In such a case, there is no need for the hydraulic reservoir 46 and an air compressor such as the air compressor 54 may be mounted directly on top of the air reservoir 26, utilizing the combination straps and mounting brackets 30. In such a case, an internal combustion engine 110, either diesel or gasoline, will typically be mounted on the frame members 40 between the cross members 42 and 44 and connected to the compressor as, for example, by a v-belt 112. In this case, one of the switches 106 may be utilized to operate an electrical starter for the internal combustion engine utilizing power supplied by the vehicular electrical system of the pickup truck on which the package is installed or, if desired, by an auxiliary battery contained within the package itself.

To further enhance the tool storage capability, the end section 18 of the horizontal section 14 may include a horizontal plate 120 adjacent the access opening 78 of the housing section 64. The plate 120 is located just forwardly of the hose reels 36,38 so as not to interfere with their operation and includes several upwardly extending projections 122 which may be in the form of steel rods welded to the plate 120. Various items may be impaled on the rods 122 for storage. For example, sockets for socket wrenches may be located on the rods 122. Alternatively, other items having an aperture extending through them may be stored on the rods 122. For example, a staple gun can be stored on the rods 122 by locating one of the rods 122 through the hand receiving section thereof. Other examples will readily occur to those skilled in the art.

The assembly is completed by cover plates, not all of which are shown. For example, a cover plate 110 extends between the top walls 80 and 96 of the housing sections 64 and 68 to provide a cover for the air compressor unit 48. Side panels 112 may be located on the ends of the vertical section. Similar panels (not shown) may be located on the long sides of the vertical section 12. Perforated panels may be utilized to extend between the frame members 40 and the cover plate 110 as well as the side wall 76,78,92,94 of the housing section to prevent access to the air compressor unit 48. It is to be noted that such panels should, however, be perforated or otherwise allow the free flow of air to assure proper operation of the oil cooler 58 or an internal combustion engine contained in the space if that option is used.

Finally, if desired, lifting eyes (not shown) may be located on the upper walls 80,96 of the housing section 64,68 to assist in the installation and removal of the package from the bed of a pickup truck.

From the foregoing, it will be appreciated that a utility package made according to the invention provides a means for both providing pneumatic power on site at remote construction or tire servicing locations, as well as for the storage of tools that may be used by workers at such sites. Because the same is mounted in a pickup truck, transportation of the various items is facilitated and yet, there is no requirement that the air compressor be periodically tied down or loosened from the bed of the pickup truck as is the case with individual units.

The provision of the hose reels within the unit provide a convenient means of storing the hoses when not in use. The use of two hose reels allows the use of one relatively large reel and one relatively small reel to minimize expense. The smaller reel may be used to store small diameter, short length of hose as might be in a tire inflating operation while the larger reel provides for the storage of an additional length of hose to assure that the hose may reach the point of use of a pneumatic tool to which the hose may be connected. Thus, a truly versatile utility package is provided.

We claim:

1. A utility package for installation in the bed of a pickup truck comprising:

a generally T-shaped frame having a relatively narrow, lower vertical section of a width narrower than the interior spacing between the sides of the bed while substantially spanning the entire interior distance between said sides and a relatively wide, upper horizontal section of a width greater than the interior spacing between said sides and no greater than about the distance between the extension of said sides and adapted to be supported on the tops of said sides;

at least one elongated pressure vessel located in a horizontal position within said vertical section;

a pair of upright housings mounted on said horizontal section oppositely of said vertical sections in spaced relation to one another and at respective ends of said horizontal section, each of said housings having a generally vertical access opening at the respective end of said horizontal section;

a closure for each of said access openings and mounted on the respective housing for movement between positions opening and closing the associated access opening;

an air compressor mounted on said frame between said housings;

a motor or an engine located on said frame between said housings and connected to said compressor to drive the same;

an upwardly opening tool box in said vertical section adjacent one end of said horizontal section and above said pressure vessel to be accessible through the housing at said one end; and at least one hose reel mounted in said vertical section adjacent the other end of said horizontal section at said other end of said horizontal section.

2. The utility package of claim 1 wherein said tool box is a rectangular container having an open upper end surrounded by depending side walls and having a bottom wall just above said pressure vessel, said side walls and said bottom wall being disposed in said vertical section and said open upper end being disposed in said horizontal section and covered by one of said housings.

3. The utility package of claim 1 further including a fluid reservoir in said vertical section and interposed between said pressure vessel and said air compressor.

4. The utility package of claim 1 wherein said pressure vessel(s) has a length less than the width of said vertical section and further including a mounting bracket within said vertical section adjacent said other end of said horizontal section and adjacent an end of said pressure vessel, said hose reel(s) being mounted on said mounting bracket.

5. The utility package of claim 1 wherein said other end of said horizontal section includes a generally horizontal tool receiving surface, and tool retaining means mounted on the upper side of said tool receiving surface.

6. The utility package of claim 5 wherein said tool retaining means comprise a plurality of upwardly directed projections.

7. The utility package of claim 6 wherein said projections are rods.

8. The utility package of claim 1 wherein there are a plurality of said pressure vessels in generally side-by-side, parallel relation defining a generally horizontal plane.

9. The utility package of claim 1 further including a cover panel extending between said housings and covering said air compressor and said motor or engine.

10. The utility package of claim 1 further including at least one exterior light mounted on the exterior at least one of said housings.

11. The utility package of claim 1 further including at least one interior light mounted on the interior of one of said housings.

12. The utility package of claim 1 further including a control panel mounted in the housing at said other end of said horizontal section.

13. A utility package for installation in the bed of a pickup truck comprising:

a generally T-shaped frame having a relatively narrow, lower vertical section of a width narrower than the interior spacing between the sides of the bed while substantially spanning the entire interior distance between said sides and a relatively wide, upper horizontal section of a width greater than the interior spacing between said sides and no greater than about the distance between the exterior of said sides and adapted to be supported on the tops of said sides;

a pair of elongated pressure vessels in generally parallel, side-by-side relation located in a horizontal position, said pressure vessels having a length less than the width of said vertical section;

a pair of upright housings mounted on said horizontal section oppositely of said vertical section in spaced relation to one another and at respective ends of said horizontal section, each of said housings having a generally vertical access opening at the respective end of said horizontal section;

a closure for each of said access openings and mounted on the respective housing for movement between positions opening and closing the associated access opening;

an air compressor mounted on said frame between said housings;

a motor or an engine located on said frame between said housings and connected to said air compressor to drive the same;

an upwardly opening rectangular tool box in said vertical section adjacent one end and having an open upper end surrounded by depending side walls and having a bottom wall just of said horizontal section and said open upper end being disposed in housing at said one end, said side walls and said bottom wall being disposed in said vertical section and said open upper end being disposed in vertical section and said open upper end being disposed in said horizontal section and covered by one of said housings;

a mounting bracket within said vertical section adjacent said other end of said horizontal section and adjacent at one end of said pressure vessels;

at least one hose reel mounted in said vertical section adjacent the other end of said horizontal section and accessible through the housing at said other end of said horizontal section, said hose reel being mounted on said mounting bracket; and a cover panel extending between said housings and covering said air compressor and said motor or engine.

14. The utility package of claim 13 wherein said air compressor is nested in said vertical section and said motor or engine is an internal combustion engine.

15. The utility package of claim 13 wherein said motor or engine is a hydraulic motor and further including a hydraulic fluid reservoir in said vertical section between said housings; said hydraulic motor and said air compressor being disposed above said reservoir; and a heat exchanger for cooling hydraulic fluid mounted between said housings.

16. A utility package for installation in the bed of a pickup truck comprising:

a frame having a relatively narrow, lower vertical section of a width narrower than the interior spacing between the sides of the bed while substantially spanning the entire interior distance between said sides and a relatively wide, upper section of a width greater than the interior spacing between said sides no greater than about the distance between the exterior of said sides and adapted to be supported on the tops of said sides;

at least one pressure vessel located within said vertical section;

a housing mounted on said horizontal section oppositely of said vertical section and extending to opposite ends of said horizontal section, said housing having access openings at respective ends of said horizontal section;

a closure for each of said access openings and mounted on the housing for movement between positions opening and closing the associated access opening;

an air compressor mounted on said frame between said access openings;

a motor or an engine located on said frame between access openings and connected to said air compressor to drive the same;

a tool box in said vertical section adjacent one end of said horizontal section and above said pressure vessel to be accessible through the housing at one end; and at least one hose reel mounted in said vertical section adjacent the other end of said horizontal section and accessible through the housing at said other end of said horizontal section.

* * * * *